US007051372B2

(12) United States Patent
Mistura

(10) Patent No.: US 7,051,372 B2
(45) Date of Patent: May 30, 2006

(54) CLOTHING ITEM

(76) Inventor: Giovanni Mistura, Via Madonnina, 82 - 1-37057, S. Giovanni Lupatoto (IT)

( * ) Notice: Subject to any disclaimer, the term of this patent is extended or adjusted under 35 U.S.C. 154(b) by 0 days.

(21) Appl. No.: 10/488,991

(22) PCT Filed: Jul. 11, 2002

(86) PCT No.: PCT/EP02/07731

§ 371 (c)(1),
(2), (4) Date: Oct. 7, 2004

(87) PCT Pub. No.: WO03/026450

PCT Pub. Date: Apr. 3, 2003

(65) Prior Publication Data

US 2005/0034209 A1 Feb. 17, 2005

(30) Foreign Application Priority Data

Sep. 21, 2001 (IT) ..... VR2001A0101

(51) Int. Cl.
*A41D 13/00* (2006.01)

(52) U.S. Cl. ..... 2/69

(58) Field of Classification Search ..... 2/102, 2/108, 115, 93, 94, 80, 85, 83, 79, 227, 244, 2/69, 275

See application file for complete search history.

(56) References Cited

U.S. PATENT DOCUMENTS 3,771,169 A * 11/1973 Edmund ..... 2/2.17
6,175,960 B1 * 1/2001 Knittel ..... 2/115
6,279,161 B1 * 8/2001 Johnston ..... 2/69

* cited by examiner

*Primary Examiner*—Tejash Patel
(74) *Attorney, Agent, or Firm*—Browdy and Neimark, PLLC

(57) ABSTRACT

Clothing item of substantially classic cut comprising a plurality of segments (3) of layered material laterally connected to each other in correspondence with junction areas (4) and each having an inner face (10) and an outer face (11). The clothing item (I) comprises, at least in correspondence with a part of at least a junction area (4) identified by at least a first and a second segment (13), (14), of layered material, a portion (12) of elastically deformable material, interposed between the first and the second segment (13), (14) of layered material. The portion (12) of elastic material allows the first and the second segment (13), (14) to be moved from a first position in which they are substantially approached, to a second position in which they are distanced, to facilitate the movement of the person wearing the clothing item. The portion (12) of elastic material can extend along the entire said junction area (4). The clothing item can also comprise a plurality of portions (12) of elastically deformable material, each positioned in correspondence with a junction area (4) between at least two segments (3).

19 Claims, 4 Drawing Sheets

CLOTHING ITEM

TECHNICAL FIELD

The present invention relates to a clothing item of the type comprising the characteristics expressed in the preamble to claim 1.

The present invention is destined to be applied to clothing items of substantially classic cut, such as trousers, skirts, jackets, suites (jacket-trousers or jacket-skirt), coats (long overcoats, three-quarter length overcoats, raincoats, . . . ), and others besides.

The present invention can also find application, still within the substantially classic sector, in the manufacture of hats, gloves, or accessories such as handbags.

Traditional clothing items are constituted by a multiplicity of segments of fabric, leather, or other material, sewn together in such a way as to give the required shape to the item.

In particular, the items of the classic type whereto the present invention is preferably destined are those constituted by substantially non extensible materials, and so shaped as to follow in the best possible manner the body of the person who wears them.

Said conformation of classic cut clothing items, however, makes them not very comfortable, since they considerably limit the wearer's movement ability.

For instance, a jacket, due to its own conformation, prevents moving the arms beyond a few basic movements.

When traditional jackets are worn, even the simplest movements can be difficult, such as washing one's hands in a normal washbowl.

If a person dares too much, there is always the risk that the jacket may be ruined (since seams tend to tear).

For this reason, a person who wears a jacket and who, for instance, has to drive a car, especially if for a long stretch of road, prefers to remove his/her jacket first to have greater freedom of movement.

Similar problems are also encountered with the other clothing items of classic cut.

DISCLOSURE OF INVENTION

In this situation the technical task constituting the basis for the present invention is to provide a clothing item of substantially classic cut that overcomes the aforementioned drawbacks.

In particular the technical task of the present invention is to obtain a clothing item of substantially classic cut that is more comfortable than traditional ones.

DESCRIPTION OF THE DRAWINGS

Further features and advantages of the present invention shall become more readily apparent from the detailed description of some preferred, but not exclusive, embodiments, of a clothing item according to the present invention, illustrated in the accompanying drawings, in which.

DESCRIPTION OF THE ILLUSTRATIVE EMBODIMENTS

With reference to the accompanying drawings, the reference number 1 globally indicates a clothing item according to the present invention.

The clothing item 1 whereto the present invention is preferably destined are, as stated, those of substantially classic cut.

The present invention is thus applicable in the manufacture of trousers, skirts, jackets, suits (jacket-trousers or jacket-skirt), coats (long overcoats, three-quarter length overcoats, raincoats, . . . ), and others besides, as well as in the manufacture of hats, gloves, or accessories such as handbags.

Figure 1:
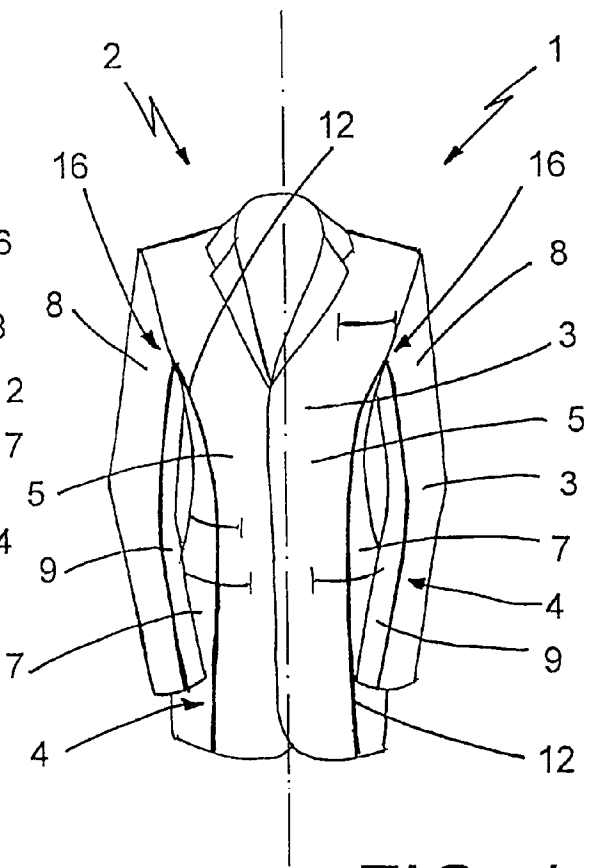
FIG. 1 shows a front elevation view of a jacket manufactured in accordance with the present invention.
Figure 2:
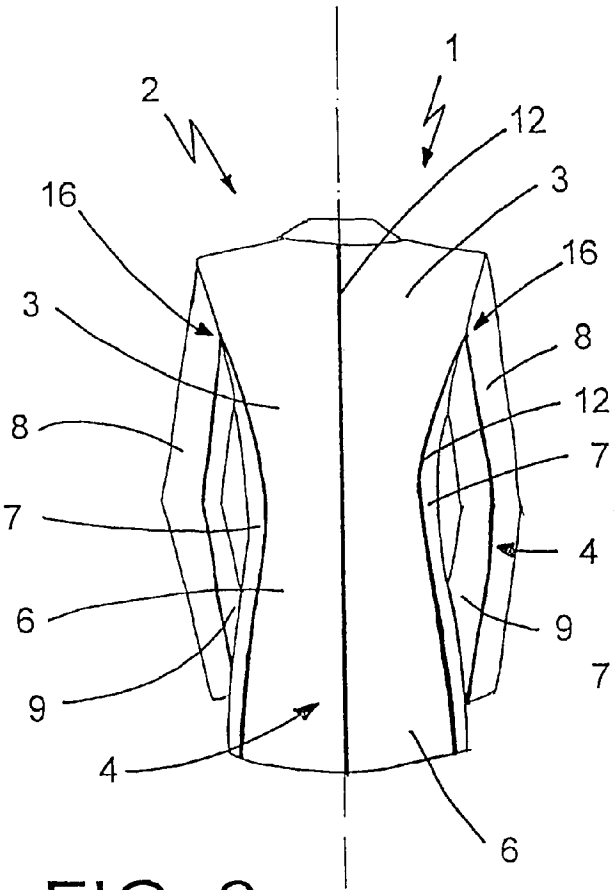
FIG. 2 shows a rear elevation view of the jacket of FIG. 1.
Figure 3:
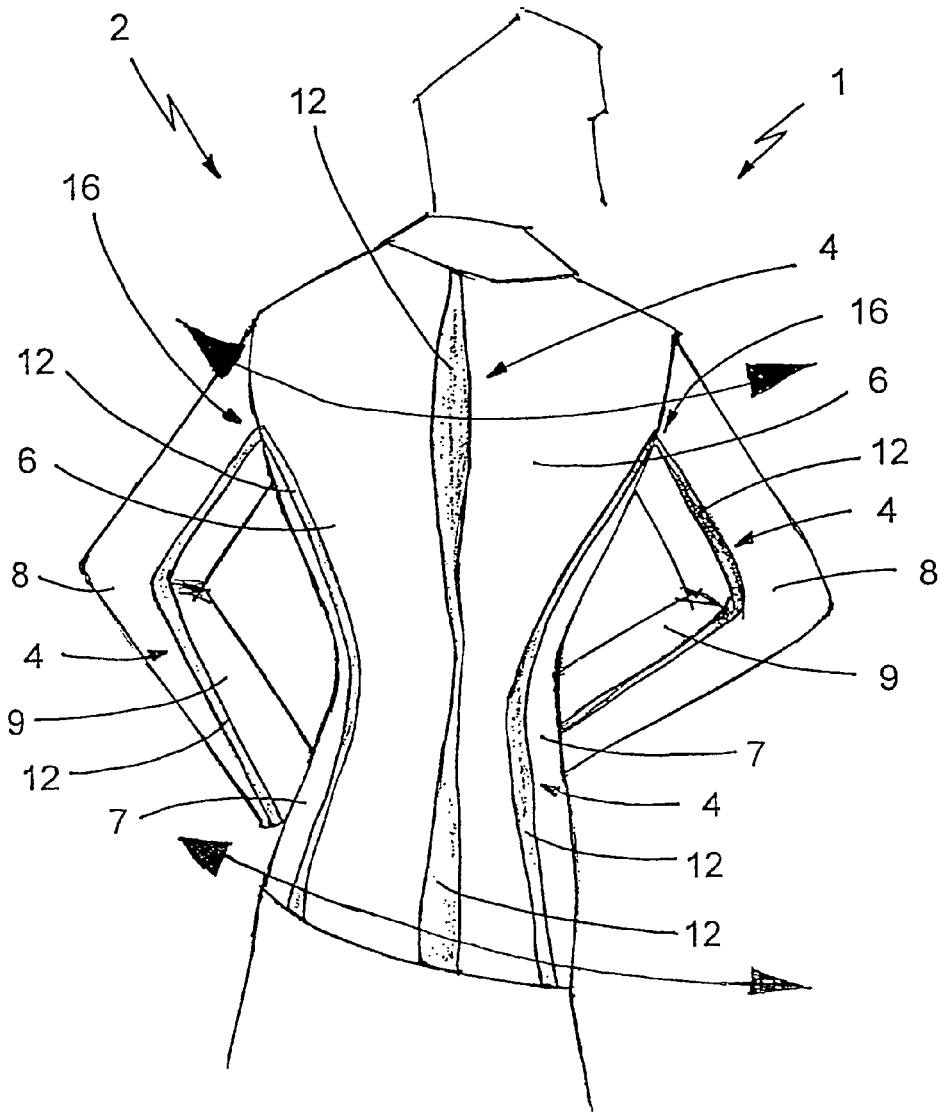
FIG. 3 shows the jacket of FIG. 2 worn by a person.

The accompanying FIGS. 1 through 3 show, as an example, the case of a jacket 2.

In general, the clothing item 1 is constituted by a plurality of segments 3 of layered material connected laterally to each other in correspondence with junction areas 4.

The segments 3 can be constituted by any type of fabric (wool, flax, cotton, . . . ), by leather, or by other substantially non-extensible materials.

In the case shown in FIGS. 1 through 3, the jacket 2 comprises ten main segments 3, whereto are added some other finishing segments (such as collar, pockets, . . . ). Among the main segments are distinguished two front segments 5, two rear segments 6, two flanks 7, two upper parts 8 of sleeves, and two lower parts 9 of sleeves.

Each segment 3 has an inner face 10 and an outer face 11.

In general, the clothing item 1 comprises at least a portion 12 of elastically deformable material, interposed between a first and a second segment 13, 14 of layered material at least in correspondence with a part of the junction area 4 between the two segments 13, 14.

Advantageously, in the preferred embodiment, the portion 12 of elastic material extends along the entire junction area 4 (FIGS. 1–3).

Moreover, in the preferred embodiment, the clothing item 1 comprises a plurality of portions 12 of elastically deformable material each positioned in correspondence with a junction area 4 between at least two segments 3 of layered material.

The jacket 2 shown in the accompanying figures comprises nine portions 12 of elastic material inserted along all the main junctions 4.

Each portion 12 of elastic material allows the motion of the first and second segment 13, 14 whereto it is associated from a first position in which said segments 13, 14 are substantially positioned next to each other (FIGS. 1 and 2), to a second position in which instead they are distanced, to facilitate the movement of the person who wears the clothing item 1 itself (FIG. 3).

Preferably, the portion 12 of elastic material is sewed to the segments 3 which delimit it. In particular, it replaces the traditional seam and constitutes the only connecting element between two adjacent segments 3.

For this purpose the portion of elastic material is sewn independently to each of the segments 3 that delimit it.

Figure 6:
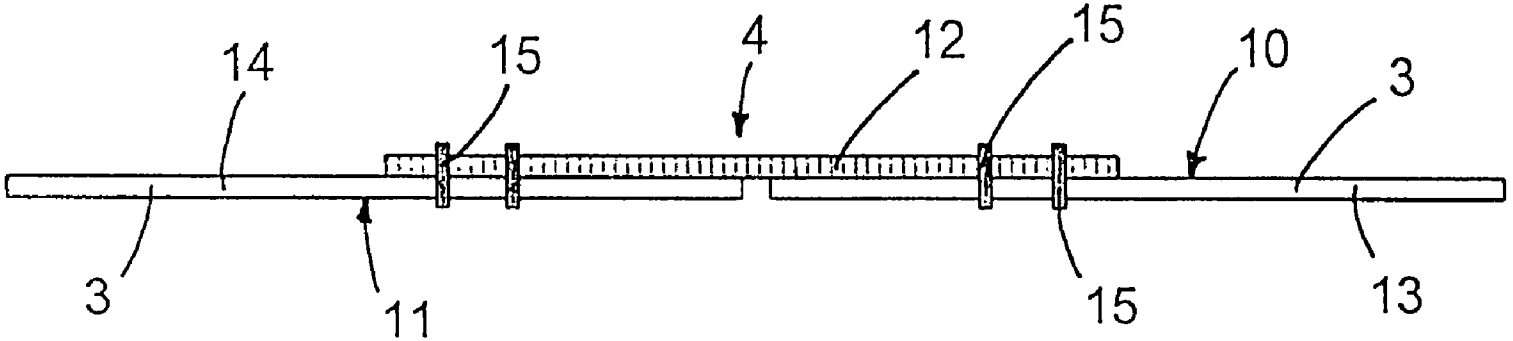
FIG. 6 shows a schematic section of a first embodiment of the present invention.

According to a first embodiment, the portion 12 of elastic material is sewn to the inner face 10 of the segments 3. In this case the thread 15 with which the seam is executed is visible on the exterior of the clothing item 1 (FIG. 6).

Figure 4:
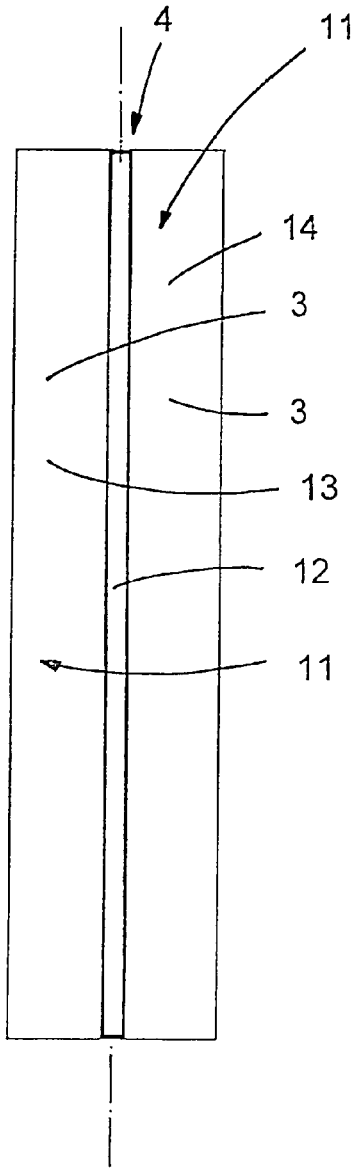
FIG. 4 shows a detail of the present invention viewed from the exterior of the clothing item.
Figure 5:
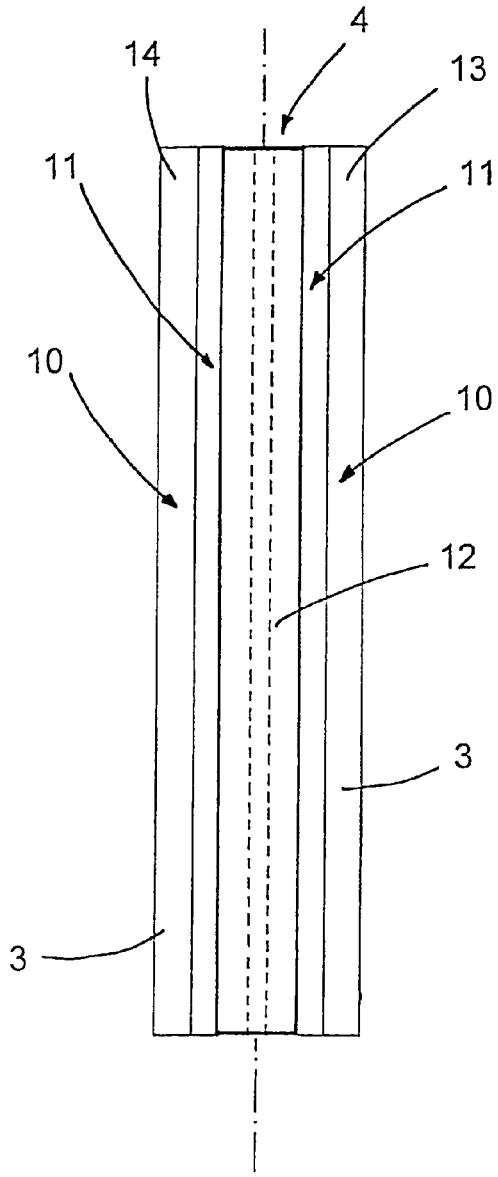
FIG. 5 shows the detail of FIG. 4 viewed from the interior of the clothing item.
Figure 7:
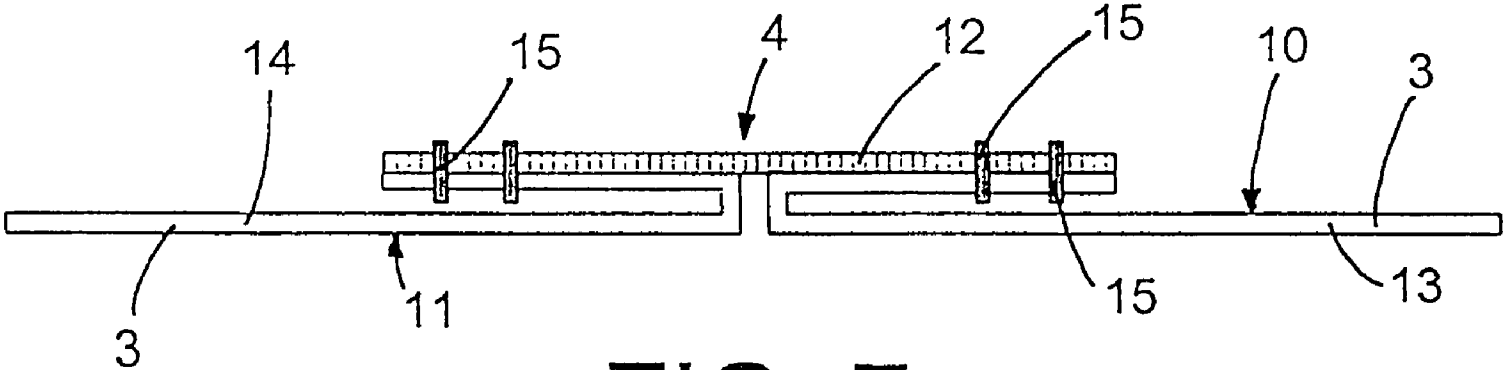
FIG. 7 shows a schematic section of a second embodiment of the present invention.

In a second embodiment, the portion 12 of elastic material is sewn to the outer face 11 of the segments 3, which is folded back towards the interior of the clothing item 1 itself, as shown in FIGS. 4, 5 and 7. In this case the thread 15 is not visible externally.

According to the preferred embodiment, the portion 12 of elastic material is any case associated to the segments 3, internally relative to the clothing item 1, and in such a way that when the segments 3 are in correspondence with the first position, the portion 12 of elastic material can be completely facing the segments 3 themselves. In this way it can remain hidden from view from the exterior of the clothing item 1.

However, this is not binding; in fact, part of the portion 12 of elastic material can remain visible at all times, as in the cases shown in FIGS. 4 through 7.

To increase the ability of the clothing item 1 to undergo deformation, the different junction areas 4 provided with the portion 12 of elastic material can be mutually joined in such a way that the elastic portion 12 inserted in correspondence with a first junction area 4 is prolonged by the elastic portion 12 inserted in a second junction area 4.

This is shown, for instance, in FIGS. 1 through 3 in which the junctions 4 between the flanks of the jacket 2 and the front and rear segments 5, 6, are prolonged by the junctions 4 between the segments 8, 9 which constitute the sleeves, in correspondence with prolongation areas 16.

The elastic material can be any, without thereby departing from the scope of the present invention. Any material can thus be used, provided it is made elastic by inserting therein fibres of Lycra or another equivalent material.

This can enable to use, in addition the classic elastic materials, also elasticised furs, elasticised satins, and so on.

Alternatively, it is possible to use the same material whereof the main segments 3 are made, appropriately elasticised.

An additional variation further provides for the elastic portion 12 to be constituted by the set of a piece of the same material that constitutes the segments 3, and of the thread 15 that joins it to the segments 3. This also applies if the material is substantially non extensible.

In this way, the elasticity is given by the variation of the distribution of the thread 15 along the entire seam. Following a localised tensioning, the thread 15 is pulled back towards the point of the tensioning, which results in a stretching of the available thread in said area. Consequently, the distance between the edges joined by the seam can increase, thereby assuring the deformation of the clothing item 1 in said area under tension. The fact distribute itself according to the initial distribution, returning the clothing item 1 to its original appearance.

Obviously, this last solution described above assures less elasticity than does the insertion of a portion 12 of elasticised material, which is advantageous in determined applications.

Advantageously, the colour of the elastic material may be the same as the segments 3, or different, depending on requirements.

The person who wears the classic clothing items 1 of the present invention can freely perform many movements.

When a movement causes a tensioning of the junction area 4 between two segments 3 of material, the portion 12 of elastic material that joins them is deformed elastically, facilitating the movement of the person (FIG. 3).

The present invention thus achieves important advantages.

The clothing item of substantially classic cut of the present invention is much more comfortable than the traditional ones equivalent thereto.

The person who wears items manufactured according to the present invention can move much more freely than with traditional items, without any fear of ruining the item itself.

It should also be noted that the present invention is relatively easy to realise and that the cost connected to the realisation of the invention is not very high.

In the case of application of the invention to classic (thus substantially rigid) handbags, a handbag with variable capacity can be obtained, albeit within well defined limits.

The invention thus conceived can be subject to numerous modifications and variations, without thereby departing from the scope of the inventive concept that characterises it.

All components can be replaced by other technically equivalent elements and in practice all materials used, as well as the shapes and dimensions of the various components, can be any depending on requirements.

The invention claimed is:

1. A clothing item of classic cut for use by a person, comprising:

a plurality of segments (3) of layered material among which can be identified at least first and second main segments wherein each of said main segments has an inner face (10) and an outer face (11);

said plurality of segments being connected to each other side-by-side in a junction area and said first and second main segments being connected to each other in a main junction area (4) having a longitudinal length which is substantially parallel to that of said person when the clothing item is in use;

wherein a portion (12) of elastically deformable material is interposed between said first and second main segments (13), (14), said portion (12) of elastic material extending substantially along an entire length of the corresponding main junction area;

said portion (12) of elastic material being sewed independently to each of said first and second main segments (13, 14) facing the main junction area (4), said portion (12) of elastic material allowing said first and second main segments (13), (14) to be moved against the elasticity of said portion (12) from a first position in which said main segments substantially approach each other and at least partially hide the elastic portion (12) so as to make the clothing item appear as a conventional one, to a second position in which said first and second main segments are spaced apart to facilitate the movement of the person wearing the clothing item.

2. The clothing item as claimed in claim 1, which further comprises at least two portions of said elastic material (12) inserted in correspondence respectively with a first and a second main junction area (4), each of the two portions of said elastic material (12) respectively extending substantially along an entire length of said first and said second main junction area, said portions of said elastic material (12) being engaged together at corresponding ends thereof at prolongation areas (16) so that the first main junction area is continuously extended by the second main junction area.

3. The clothing item as claimed in claim 1, wherein said portion (12) of elastic material is engaged to said main segments (13, (14) internally to the clothing item.

4. The clothing item as claimed in claim 1, wherein longitudinal edges of said portion (12) of elastic material are respectively sewed to the inner face (10) of corresponding main segments (13), (14).

5. The clothing item as claimed in claim 1, wherein longitudinal edges of said portion (12) of elastic material are respectively sewed to the outer face (11) of corresponding main segments (13), (14).

6. The clothing item as claimed in claim 5, wherein said outer face (11) is folded back towards the interior of the clothing item to engage the junction area.

7. The clothing item as claimed in claim 1, wherein said elastic portion (12) is made of the same material whereof the main segments (13), (14) are made, appropriately elasticized.

8. The clothing item as claimed in claim 1, wherein, when in said first position, said portion (12) of elastic material completely faces said main segments (13), (14) so that said portion of elastic material is hidden from view from the exterior of said clothing item (1).

9. The clothing item as claimed in claim 1, wherein said clothing item is a coat or jacket, said main segments of said coat or jacket are at least two front segments (5), two rear segments (6), two flanks (7), two upper parts (8) of sleeves, and two lower parts (9) of sleeves, each front segment (5) being connected to a flank (7) by a front junction area (4), each rear segment (6) being respectively connected to said flanks by a lateral rear junction area, the rear segments (6) to each other by a central rear junction area, and each upper part (8) of sleeves being connected to the lower part (9) of the respective sleeve by a front sleeve junction area and a rear sleeve junction area, said portion of elastic material being inserted in said lateral rear, central rear and rear sleeve junction areas of said coat or jacket.

10. The coat or jacket as claimed in claim 9, wherein each said lateral rear junction areas is continuous with a respective rear sleeve junction area.

11. The clothing item as claimed in claim 9, wherein said portion of elastic material is inserted in said front sleeve junction areas of said coat or jacket.

12. The clothing item as claimed in claim 11, wherein each said front junction area is continuous with a respective front sleeve junction area.

13. The clothing item as claimed in claim 12, wherein said portion (12) of elastic material is respectively engaged to said segments (13), (14) internally to the coat.

14. The clothing item as claimed in claim 13, wherein longitudinal edges of said portion (12) of elastic material are respectively sewed to the inner face (10) of a corresponding main segment (13), (14).

15. The clothing item as claimed in claim 13, wherein longitudinal edges of said portion (12) of elastic material are respectively sewed to the outer face (11) of corresponding main segment (13), (14).

16. The clothing item as claimed in claim 15, wherein said outer face (11) is folded back towards the interior of the coat to engage the junction area.

17. The clothing item as claimed in claim 16, wherein said elastic portion (12) is made of the same material whereof the segments (13), (14) are made, appropriately elasticized.

18. The clothing item as claimed in claim 17, wherein, when in said first position, said portion (12) of elastic material completely faces said main segments (13), (14) so that said portion of elastic material is hidden from view from the exterior of said clothing item (1).

19. The clothing item as claimed in claim 1, wherein the clothing item is a coat or jacket.

* * * * *